US010018329B1

(12) United States Patent
Belliveau

(10) Patent No.: US 10,018,329 B1
(45) Date of Patent: Jul. 10, 2018

(54) FRAMING CONTRAST OF MULTIPARAMETER THEATRICAL LIGHTING FIXTURES

(71) Applicant: Richard S Belliveau, Austin, TX (US)

(72) Inventor: Richard S Belliveau, Austin, TX (US)

( * ) Notice: Subject to any disclaimer, the term of this patent is extended or adjusted under 35 U.S.C. 154(b) by 0 days.

(21) Appl. No.: 15/643,151

(22) Filed: Jul. 6, 2017

(51) Int. Cl.
*F21V 7/00* (2006.01)
*F21V 11/18* (2006.01)
*F21V 14/08* (2006.01)
*F21W 131/406* (2006.01)

(52) U.S. Cl.
CPC ..... *F21V 11/186* (2013.01); *F21V 14/08* (2013.01); *F21W 2131/406* (2013.01)

(58) Field of Classification Search
CPC ..... F21Y 2103/00; F21Y 2115/10; F21Y 2103/10; F21Y 2107/30; F21Y 2107/40; F21Y 2113/00; F21Y 2113/13; F21V 11/02; F21V 13/04; F21V 15/01; F21V 29/75; F21V 3/04; F21V 3/0625; F21V 5/002
USPC ..... 362/297
See application file for complete search history.

(56) References Cited

U.S. PATENT DOCUMENTS 2,195,166 A 3/1940 Diggins
2,439,330 A 4/1948 Zander
2,465,578 A 3/1949 Czarnikow et al.
4,890,208 A 12/1989 Izenour
4,972,306 A 11/1990 Bornhorst
5,345,371 A 9/1994 Cunningham et al.
6,199,987 B1 * 3/2001 Haba ..... G02B 27/283 348/E5.139
6,241,366 B1 6/2001 Roman et al.
6,744,693 B2 6/2004 Brockmann et al.
6,939,026 B2 9/2005 Gennrich et al.
8,081,367 B2 12/2011 Bornhorst
8,220,976 B2 * 7/2012 Liu ..... F21V 5/02 362/373
8,911,120 B2 12/2014 Dalsgaard et al.
8,950,904 B2 2/2015 Cavenati et al.
9,366,415 B2 6/2016 Jurik et al.
2003/0048640 A1 3/2003 Reinert
2005/0281023 A1 * 12/2005 Gould ..... F21S 8/04 362/217.05
2009/0190348 A1 * 7/2009 Lin ..... F21S 6/003 362/235
2010/0277908 A1 * 11/2010 Hu ..... F21V 15/01 362/235

(Continued)

*Primary Examiner* — Thien M Le
(74) *Attorney, Agent, or Firm* — Walter J Tencza, Jr.

(57) ABSTRACT

A plurality of framing blades; and a multiparameter theater light including a light source; and an optical component. Each of the plurality of framing blades configured to be placed in a path of the light source so that at least one surface of each of the plurality of framing blades reflects light rays from the light source. At least one surface of each of the plurality of framing blades may include a plurality of peaks and a plurality of troughs, alternating between a peak and a trough, and the distance between adjacent peaks varies; and wherein light rays incident on the at least one surface with the same angle of incidence with respect to a straight line defining a length of each of the plurality of framing blades, have a different angle of reflection with respect to the straight line, depending on where the light rays are incident on.

20 Claims, 5 Drawing Sheets

(56) References Cited

U.S. PATENT DOCUMENTS

| | | | | |
|---|---|---|---|---|
| 2015/0070901 | A1* | 3/2015 | Rich | F21V 5/02<br>362/311.01 |
| 2016/0018077 | A1* | 1/2016 | Mallory | F21V 5/007<br>362/311.02 |
| 2016/0033108 | A1* | 2/2016 | Ji | F21V 5/04<br>315/297 |
| 2016/0377275 | A1* | 12/2016 | Lim | G01J 5/0806<br>362/362 |

* cited by examiner

FRAMING CONTRAST OF MULTIPARAMETER THEATRICAL LIGHTING FIXTURES

FIELD OF THE INVENTION

This invention relates to multiparameter theatrical lighting fixtures.

BACKGROUND OF THE INVENTION

Multiparameter theatrical lighting fixtures are lighting fixtures, which illustratively have two or more individually remotely adjustable parameters such as focus, color, image, position, or other light characteristics. Multiparameter lighting fixtures are widely used in the lighting industry because they facilitate significant reductions in overall lighting system size and permit dynamic changes to the final lighting effect. Applications and events in which multiparameter lighting fixtures are used to great advantage include showrooms, television lighting, stage lighting, architectural lighting, live concerts, and theme parks. The lamp housing of a multiparameter light contains optical components and a light source.

One of the parameters of many multiparameter lights is the framing parameter that operates a framing system. The framing system is used to "frame" an object on a stage with light generated by the multiparameter light. A framing system can include of two or more framing blades that can be remotely positioned in the light path of the multiparameter light.

One such multiparameter light that incorporates a framing parameter is the SolaTheatre (trademarked) multiparameter light produced by High End Systems of Austin, Tex. as disclosed at https://www.highend.com/products/led/solatheatre/. The SolaTheatre (trademarked) multiparameter light is particularly challenging to the framing system because it is designed for use in a theatre and operates completely without the aid of fan cooling to remain quiet in operation. The framing blades of the SolaTheatre (trademarked) multiparameter light are exposed to high density light energy. U.S. Pat. No. 4,890,208 to Izenour describes a multiple-blade gate for establishing the outline of the beam and that the blades can be expected to warp because of residual infrared energy in the intercepted beam.

It is important that the framing system of a multiparameter light frame an object on a stage with a high contrast ratio so that the intended framed object is illuminated but yet the area to the outside of the framed object be as dark as possible. As the state of the art of automated lighting increases the illumination available from a multiparameter light, it becomes even more important to maintain a high contrast ratio to meet the expectations of the theatrical professional.

SUMMARY OF THE INVENTION

In at least one embodiment, an apparatus is provided comprising a plurality of framing blades; and a multiparameter theatre light comprising a light source; and an optical component. Each of the plurality of framing blades may be configured to be placed in a path of the light source so that at least one surface of each of the plurality of framing blades reflects light rays from the light source.

At least one surface of each of the plurality of framing blades may be comprised of a plurality of peaks and a plurality of troughs, such that the at least one surface alternates between a peak and a trough, and the distance between adjacent peaks varies; and wherein light rays incident on the at least one surface with the same angle of incidence with respect to a straight line defining a length of each of the plurality of framing blades, have a different angle of reflection with respect to the straight line, depending on which part of the at least one surface, the light rays are incident on.

Each of the plurality of framing blades may have a thickness; at least one of the plurality of peaks is at least a specified distance away from an adjacent peak on a corresponding framing blade of the plurality of framing blades, for each of the plurality of framing blades; and wherein the specified distance may be equal to or greater than the thickness of the corresponding framing blade of the plurality of framing blades.

There may be a specified difference between a peak height of at least one peak of the plurality of peaks and a trough height of at least one adjacent trough of the plurality of troughs on a corresponding blade of the plurality of blades, for each of the plurality of framing blades. The specified difference may be about half of the thickness of a corresponding framing blade of the plurality of framing blades, for each of the plurality of framing blades. The peak height and the trough height may be perpendicular to the straight line defining the length of a corresponding framing blade, for each of the plurality of framing blades.

The plurality of peaks and the plurality of troughs may be formed by texturing and/or embossing, and may be geometrically arranged.

Each of the plurality of framing blades may include a coating and a base, wherein the coating is applied to a first side of the base, and a second side of the base, opposite the first side of the base, does not have the coating; wherein the at least one surface of each of the plurality of framing blades is a surface of the coating; and wherein the surface of the coating provides less reflection of light directed onto the at least one surface for each of the plurality of framing blades, compared to light directed onto the second side of the base, for each of the plurality of framing blades. The coating may be a dry film lubricant. The dry lubricant may be comprised of molybdenum or graphite or tungsten.

A method comprising the steps of placing a first framing blade in the path of a light source of a multiparameter theatre light having an optical component, so that at least one surface of the first framing blade reflects light rays from the light source; wherein the at least one surface of the first framing blade is comprised of a plurality of peaks and a plurality of troughs, such that the at least one surface of the first framing blade alternates between a peak and a trough, and the distance between adjacent peaks varies; and wherein light rays incident on the at least one surface of the first framing blade with the same angle of incidence with respect to a straight line defining a length of the first framing blade, have a different angle of reflection with respect to the straight line, depending on which part of the at least one surface of the first framing blade, the light rays are incident on.

The method may be further comprised of placing one or more further framing blades in the path of the light source of the multiparameter theatre light having the optical component, so that at least one surface of the one or more further framing blade reflect light rays from the light source; wherein the at least one surface of the one or more further framing blades is comprised of a plurality of peaks and a plurality of troughs, such that the at least one surface of the one or more further framing blades alternates between a peak and a trough, and the distance between adjacent peaks varies; and wherein light rays incident on the at least one surface of the one or more further framing blades, with the same angle of incidence with respect to a straight line defining a length of the first framing blade, have a different angle of reflection with respect to the straight line, depending on which part of the at least one surface of the one or more further framing blades, the light rays are incident on.

The first framing blade and the one or more further framing blades may make up a plurality of framing blades, which may be configured as previously described.

DETAILED DESCRIPTION OF THE DRAWINGS

Figure 1:
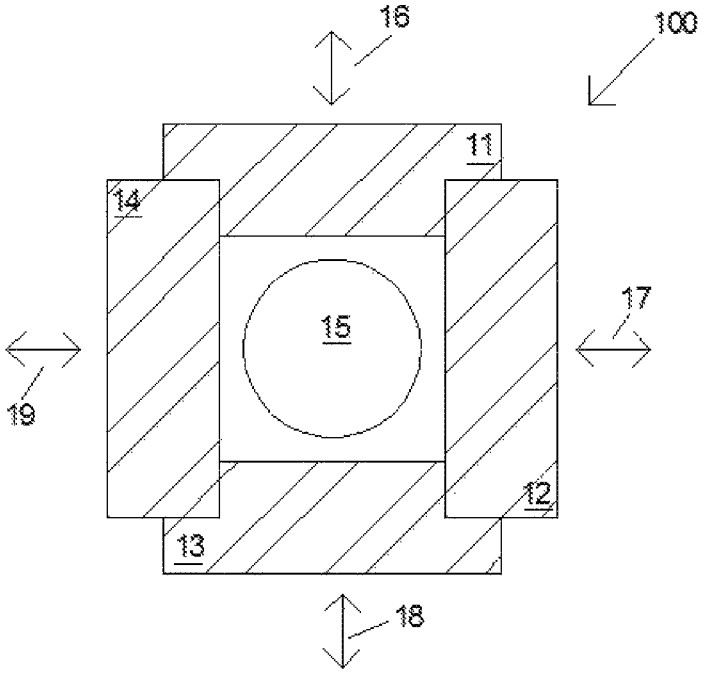
Fig. 1 (Prior Art)
FIG. 1 shows a simplified diagram of a prior art framing system with four shutter blades.

FIG. 1 shows a simplified diagram of a prior art framing system 100 with four shutter blades 11, 12, 13 and 14. An aperture and light source 15 is shown where a light path of concentrated light from a light source of a multiparameter light, such as multiparameter light 900, shown in simplified form, passes through. Shutter blade 11 can move in front of the aperture and light source 15, so that blade 11 overlaps part or all of the aperture and light source 15, by a motor such as including a member similar to member 91 for framing blade 71, shown in FIG. 9B in the directions of arrows 16. Shutter blade 12 can move in front of the aperture 15, so that blade 12 overlaps part or all of the aperture 15, by a motor such as including a member similar to member 91 for framing blade 71 shown in FIG. 9B, in the directions of arrows 17. Shutter blade 13 can move in front of the aperture and light source 15, so that the blade 13 overlaps part or all of the aperture 15, by a motor such as including a member similar to member 91 for framing blade 71, in the directions of arrows 18. Shutter blade 14 can move in front of the aperture 15, so that the blade 14 overlaps part or all of the aperture 15, by a motor such as including a member similar to member 91 for framing blade 71 in the directions of arrows 19. The shutter blades 11, 12, 13 and 14 may be comprised substantially or entirely of a stainless steel sheet approximately one quarter of a millimeter thick. The grade of stainless steel is usually a high grade stainless steel, such as grade 316 stainless steel as known in the art to help reduce oxidization. Oxidization of any of the shutter blades 11, 12, 13, and 14, happens when the stainless steel of the shutter blades 11, 12, 13, and 14 is exposed to high density light energy and the surface temperature of the stainless steel of the blades 11, 12, 13, and 14 due to the high density light energy, can reach temperatures in excess of six hundred degrees Celsius. The shutter blades 11, 12, 13, and 14 may be manufactured with a mill finish as known in the art of metallurgy which provides the blades 11, 12, 13, and 14 a substantially reflective property in the range of 60% to 30% depending on the material.

Figure 2:
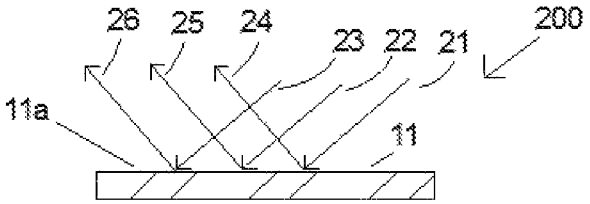
Fig. 2 (Prior Art)
FIG. 2 shows a simplified diagram of a light reflecting pattern of a prior art frame blade cross section, wherein the prior art frame blade may be one of the four shutter blades of FIG. 1.

FIG. 2 shows a simplified diagram of a light reflecting pattern 200 of a cross section of the shutter blade 11. Arrows 21, 22 and 23 show light rays from a substantially collimated light source as known in the art of multiparameter lights (not show for simplification) directed towards a blade surface 11*a* of the blade 11. The blade surface 11*a* has a mill finish which is substantially reflective to visible light. Generally, a "mill finish" is known in metallurgy, and is defined in the present application as follows: "Mill finish refers to the surface finish of metal after it exits a rolling mill, extrusion die, or drawing processes, including sheet, bar, plate, or structural shapes. This surface finish usually lacks lustre it may have spots of oxidation or contamination with mill oil. Most mill finish surfaces are machined or treated with polishing, industrial etching, or some other surface finishing process before they are considered complete." (Definition of "Mill finish", first paragraph of https://en.wikipedia.org/wiki/Mill_finish).

Arrow 24 show the reflected light ray direction of arrow 21, off of the blade surface 11*a*. Arrow 25 shows the reflected light ray direction of arrow 22, off of the blade surface 11*a*. Arrow 26 shows the reflected light ray direction of arrow 23, off of the blade surface 11*a*.

Unfortunately the reflected light rays 24, 25 and 26 are all headed in substantially the same general direction from the surface 11*a*. It is common for these directional rays 24, 25 and 26 to all shine upon an optical component of a multiparameter light such as a lens component (not shown for simplicity) wherein the lens component can reduce the contrast ratio during the use of the framing parameter. The mill finish of the surface 11*a* of the framing blade or shutter blade 11 is too reflective in this prior art framing system, apparatus, and method 100 for the critical standards of the theatrical professional. Oxidization of the framing blades or shutter blades 11, 12, 13, and 14 due to heat can also cause a framing system, apparatus and method 100 to fault as it can make the blades 11, 12, 13, and 14, difficult to slide upon each other causing a mechanical malfunction.

Figure 3:
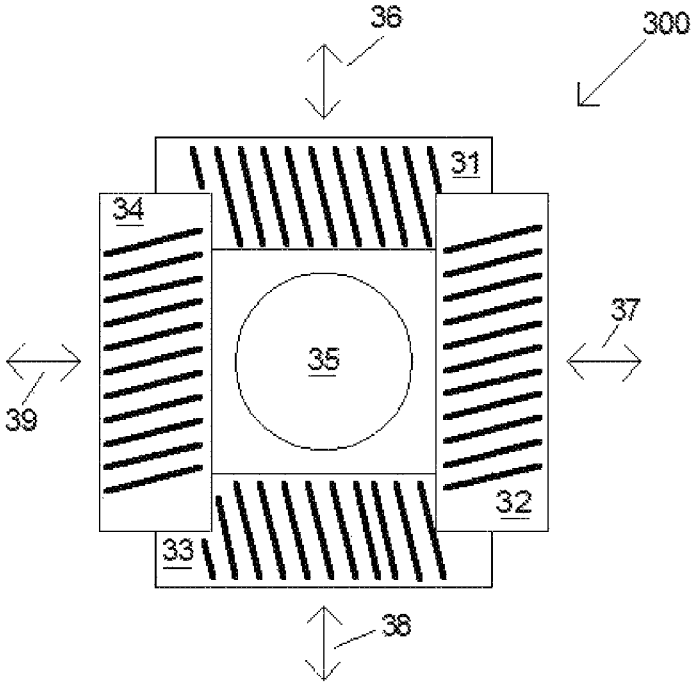
Fig. 3 (Prior Art)
FIG. 3 shows another prior art framing system.

FIG. 3 shows another prior art framing system, apparatus and method 300. An aperture and light source 35 is shown where a light path of concentrated light from a light source of a multiparameter light, such as similar to multiparamter light 900 shown in FIG. 9B, passes through. Shutter blade 31 is configured to move in front of the aperture 35, so that blade 31 overlaps part or all of the aperture and light source 35, by a motor such as including a member similar to member 91 for framing blade 71 shown in FIG. 9B, in the directions of arrows 36. Shutter blade 32 is configured to move in front of the aperture 35, so that blade 32 overlaps part or all of the aperture and light source 35, by a motor such as including a member similar to member 91 for framing blade 71 shown in FIG. 9B, in the directions of arrows 37. Shutter blade 33 is configured to can move in front of the aperture 35, so that blade 33 overlaps part or all of the aperture and light source 35, by a motor such as including a member similar to member 91 for framing blade 71, in the directions of arrows 38. Shutter blade 34 is configured to can move in front of the aperture 35, so that blade 34 overlaps part or all of the aperture and light source 35, by a motor such as including a member similar to member 91 for framing blade 71 of FIG. 9B in the directions of arrows 39.

The shutter blades 31, 32, 33, and 34 may be comprised substantially or entirely of high grade stainless steel such as 316 grade stainless steel. The shutter blades 31, 32, 33 and 34, in at least one embodiment, have their surfaces coated with a dry film coating of molybdenum on one or both sides, i.e. the side facing the aperture 35 and the side facing away from the aperture 35. The molybdenum coating serves two useful properties. First the molybdenum coating reduces the oxidization of the stainless surfaces of the shutter blades 31, 32, 33 and 24. Second the molybdenum is a very dark coating that greatly reduces the reflective property of the typically mill finish shutter blades 31, 32, 33, and 34.

Figure 4:
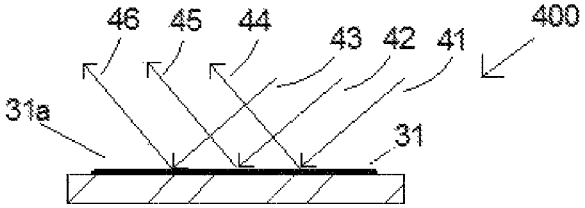
Fig. 4 (Prior Art)
FIG. 4 shows a prior art light reflecting pattern of a prior art frame blade cross section, for a frame blade which may be a shutter blade shown in FIG. 3.

FIG. 4 shows a light reflecting pattern 400 of the prior art frame blade 31 and a cross section of the blade 31. The frame blade 31 has its surface 31*a* coated with a film of molybdenum on one or both sides, including on the side that faces towards the aperture 35 and the side that faces away from the aperture 35. Arrows 41, 42 and 43 show light rays from a substantially collimated light source as known in the art of multiparameter lights (not show for simplification) directed towards the molybdenum coated surface 31*a*. Arrows 44 shows the reflected light ray direction of arrow 41, reflected off of the surface 31*a*. Arrows 45 shows the reflected light ray direction of arrow 42, reflected off of the surface 31*a*. Arrow 46 shows the reflected light ray direction of arrow 43, reflected off of the surface 31*a*.

By using the molybdenum film coating, the reflection from the surface 31*a* is substantially reduced by greater than 85% by absorption of the molybdenum coating depending on the uniformity of the coating. The reduced reflection light rays 44, 45 and 46 are still, however all headed in generally direction from surface 31*a* as shown. The reduced reflection rays 44, 45 and 46 can still shine upon an optical component of a multiparameter light such as a lens component, such as lens or lens component 904 shown in FIG. 9A. The reduced reflected light shining upon the lens component still can be noticeable during operation of a multiparameter light in use and it is desirable to further reduce possible reflections to meet the expectations of the theatrical professional.

After working with many light absorbing dry film coatings including graphite, tungsten and molybdenum the inventor of the present application has been determined that all of these light absorbing coatings still have too much residual reflective properties to meet the need of the theatrical industry. It was necessary to find an innovative solution that incorporates altering the surface topology of the shutter blades, such as shutter blades 11, 12, 13, and 14 or shutter blades 31, 32, 33, and 34 before applying the dry film coatings to scatter the residual light thus spreading the residual reflective energy over a larger area.

Figure 5:
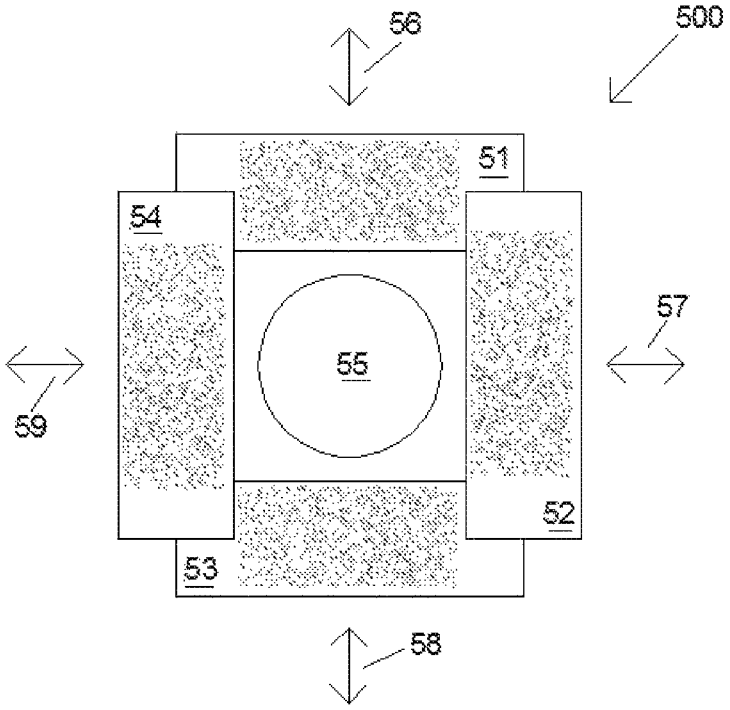
FIG. 5 shows a simplified diagram of a framing system, method, and apparatus in accordance with an embodiment of the present invention.

FIG. 5 shows a framing system, method, and apparatus 500 in accordance with one embodiment of the present invention. Aperture and light source 55 is shown where a light path of concentrated light from a light source of a multiparameter light, such as multiparameter light 900 shown in FIG. 9B passes through. Apparatus 500 includes a shutter blade 51 which is configured to can move in front of the aperture 55, so that blade 51 overlaps part or all of the aperture 55, by a motor such as including a member similar to member 91 for framing blade 71, shown in FIG. 9B, in the directions of arrows 56. Shutter blade 52 is configured to can move in front of the aperture 55, so that blade 52 overlaps part or all of the aperture 55, by a motor such as including a member similar to member 91 for framing blade 71 shown in FIG. 9B, (by a motor now shown for simplification) in the directions of arrows 57. Shutter blade 53 is configured to can move in front of the aperture and light source 55, so that blade 53 overlaps part or all of the aperture 55, by a motor such as including a member similar to member 91 for framing blade 71 shown in FIG. 9B, in the directions of arrows 58. Shutter blade 54 is configured to can move in front of the aperture 55, so that blade 54 overlaps part or all of the aperture 55, by a motor such as including a member similar to member 91 for framing blade 71 shown in FIG. 9B, in the directions of arrows 59.

Each of the shutter blades 51, 52, 53, and 54 may be a stainless steel sheet, and each may be comprised of high grade stainless steel such as 316 grade. Shutter blades 51, 52, 53 and 54 have had their surface topology altered. The shutter blades 51, 52, 53, and 54 of shutter system, apparatus, and method 500 are not coated with any dry film coating. The surface topology alteration method can be by abrasive blasting, laser milling or embossing. Other surface topology modifications may include tumbling or acid etching of patterns. The surface topology modification may be geometrical or random. A geometrical surface topology modification can provide a better known distribution pattern of the reflected light from the shutter blades. Alternatively the surface topology modification can be a random texturing. Although generally texturing or embossing of stainless steel is known, using a modified surface for reducing reflection on a framing system of a multiparameter is not known in the art.

Figure 6:
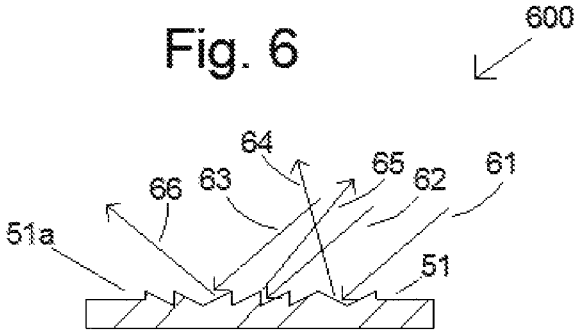
FIG. 6 shows a light reflecting pattern of a cross section of a shutter blade, which can be used with the framing system, method, and apparatus shown in FIG. 5.

FIG. 6 shows the light reflecting pattern 600 of the shutter blade 51. FIG. 6 shows a cross section of the shutter blade 51. A surface 51*a*, is shown of the side of the blade 51 that faces away from the aperture 55. However, depending on the where the reflection location in the multiparameter light needs to be reduced from the shutter blades, a modified surface topology like surface 51*a* can be on one or both sides of shutter blade 51. Arrows 61, 62 and 63 show light rays from a substantially collimated light source as known in the art of multiparameter lights (not show for simplification) directed towards the surface 51*a* which is formed as a result of a surface topology modification technique. Arrows 64 shows the reflected light ray direction of arrow 61, following reflection by surface 51*a*. Arrows 65 shows the reflected light ray direction of arrow 62, following reflection by surface 51*a*. Arrow 66 shows the reflected light ray direction of arrow 63, following reflection by surface 51*a*. After surface topology modification the reflected light rays as shown by FIG. 6 are directed from the surface 51*a* at substantially different exiting angles greatly reducing any localized concentration of the reflected energy. Substantially different angles is defined as over 80% of the reflected light rays exit the surface of the shutter blade in different directions.

Figure 7:
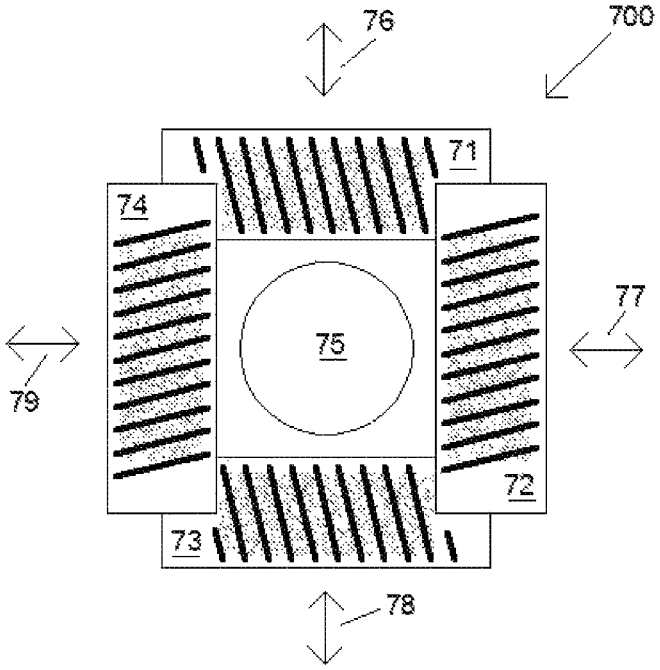
FIG. 7 shows a simplified diagram of another framing system, method, and apparatus in accordance with another embodiment of the present invention.

FIG. 7 shows a framing system, method, and apparatus 700, in accordance with another embodiment of the invention where the surface topology modified framing blades 71, 72, 73 and 74 have a dry film coating such as molybdenum, graphite or tungsten applied over a modified surface topology such as the surface topology of surface 51*a* as illustrated in FIG. 6. The surface topology modification of FIG. 7, needs to be deep enough to allow the dry film coating to follow the contour of the modified topology surface.

Aperture and light source 75 is shown where a light path of collimated light from a light source of a multiparameter light as known in the art passes through. Shutter blade 71 is configured to can move in front of the aperture 75, so that blade 71 overlaps part or all of the aperture 75, by a motor such as including member 91 for framing blade 71 in FIG. 9B, in the directions of arrows 76. Shutter blade 72 is configured to can move in front of the aperture 75, so that blade 72 overlaps part or all of the aperture 75, by a motor such as including a member 92 for framing blade 72, shown in FIG. 9B, in the directions of arrows 77. Shutter blade 73 is configured to can move in front of the aperture 75, so that blade 73 overlaps part or all of the aperture and light source 75, by a motor such as including a member 93 for framing blade 73 shown in FIG. 9B, in the directions of arrows 78. Shutter blade 74 is configured to move in front of the aperture and light source 75, so that blade 74 overlaps part or all of the aperture 75, by a motor such as including a member 94 for framing blade 74 shown in FIG. 9B, in the directions of arrows 79. The shutter blades 71, 72, 73, and 74 may be substantially or entirely comprised of high grade stainless steel such as 316 grade.

The surface topology modification creates several improvements for the shutter system, apparatus, and method 500 of FIG. 5 and the shutter system, apparatus, and method 700 of FIG. 7. First unmodified mill flat surfaces make greater contact with each other because they are flat surfaces. This creates a higher friction. The modified surfaces, in accordance with one or more embodiments of the present invention, such as surfaces 51*a* and 71*a*, have less contact area between shutter blades since they no longer have a flat topology. Second the surface topology modification scatters the reflected light rays.

Figure 8:
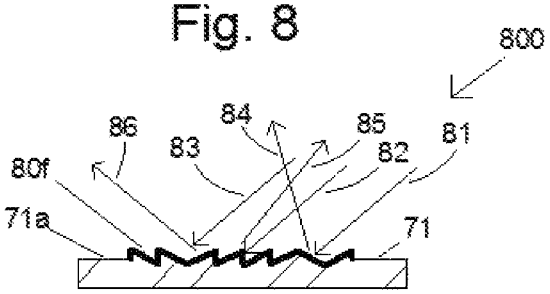
FIG. 8 shows a light reflecting pattern of a cross section of shutter blade which can be used with the framing system, method, and apparatus of FIG. 7.

FIG. 8 shows a light reflecting pattern 800 of a surface 71*a* of the blade 71. FIG. 8 shows a cross section of the blade 71. The surface 71*a* of the shutter blade 71 has had the surface topology modified of the surface 71*a* and a dry film coating 80*f* such as molybdenum, graphite or tungsten applied over the top of the surface 71*a*. The dry film coating helps to resist oxidization of the stainless steel and to greatly reduce the reflectivity of the surface 71*a*. Arrows 81, 82 and 83 show light rays from a collimated light source of a multiparameter light as known in the art (not show for simplification) directed towards the surface topology modified blade surface 71*a*. Arrows 84 shows the reflected light ray direction of arrow 81. Arrows 85 shows the reflected light ray direction of arrow 82. Arrow 86 shows the reflected light ray direction of arrow 83. After surface topology modification, the reflected light rays as shown by FIG. 8 are directed from the surface at substantially different exiting angles greatly reducing any localized concentration of the reflected energy with the additional reduction of reflective energy provided by the dry film coating 80*f*. Note that the surface 71*a* may be typically described as including the coating 80*f*. Substantially different exiting angles is defined as greater than 80 of the light rays exit the surface of the blade 71 at different angles to avoid a localizing of the reflected rays.

The modification of a metal surface topology for reduction of reflected light could be used effectively for the stainless steel blades of an iris that is also commonly placed into the light path of a multiparameter light. The use of an iris to control a beam diameter is known in the art. Other structures within a multiparameter light that may have need to critically control the amount of reflected light may also benefit from surface topology modifications as described.

Figure 9A:
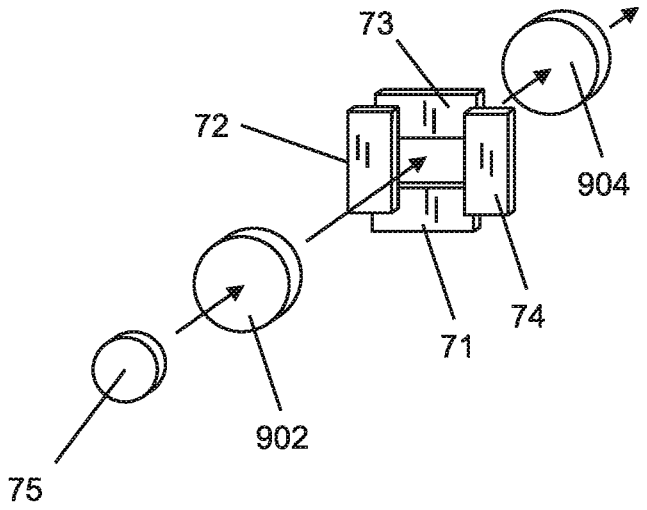
FIG. 9A shows a simplified perspective view of components for a framing system, method, and apparatus in accordance with an embodiment of the present invention.
Figure 9B:
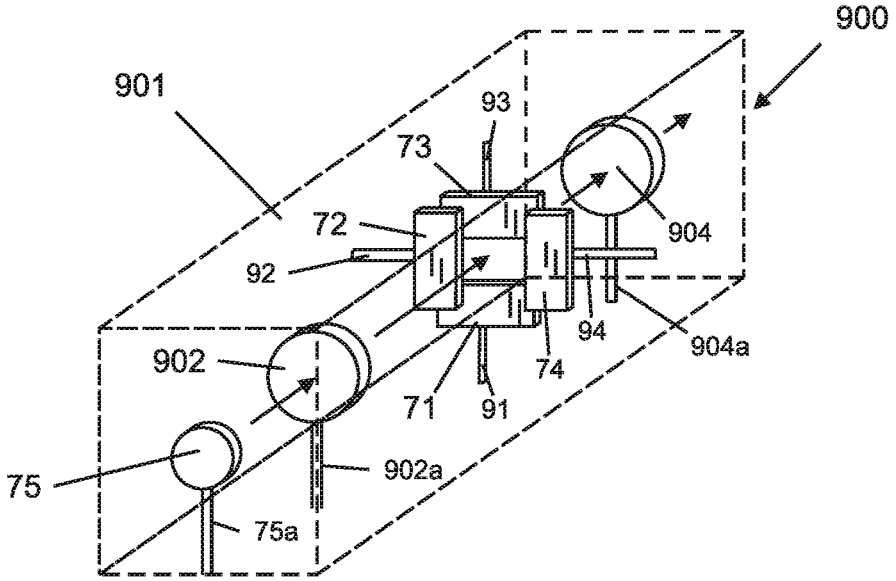
FIG. 9B shows a simplified view of a framing system, method, and apparatus in accordance with an embodiment of the present invention, including a multiparameter theatre light

FIG. 9A shows a simplified perspective view of components for a framing system, method, and apparatus in accordance with an embodiment of the present invention. FIG. 9B shows a simplified view of a framing system, method, and apparatus in accordance with an embodiment of the present invention, including a multiparameter theatre light 900.

FIG. 9A shows a simplified diagram of light source and aperture 75, a lens 902, framing blades 71, 72, 73, and 74, and a lens 904. Light from the light source and aperture 75 is emitted towards one side of the lens 902, is transmitted through the lens 902, and comes out the opposite side of the lens 902, toward the framing blades 71, 72, 73, and 74. The light passes through the open central region between and/or bordered by the framing blades 71, 72, 73, and 74, and is emitted towards one side of the lens 904. The light is transmitted through the lens 904 out the opposite side of the lens 904.

FIG. 9B shows the components as in FIG. 9A and also a simplified diagram of multiparameter light 900, which may described as including the components of FIG. 9A. The light source and aperture 75, the lens 902, and the lens 904 may be fixed, such as by members 75*a*, 902*a*, and 904*a*, respectively, to a housing 901 (shown by dashed lines) of the multiparameter light 900. In operation, framing blades 71, 72, 73, and 74 can be moved, by member or motor component 91, 92, 93, and 94, respectively, into the path of light transmitted from the light source and aperture 75 and through the lens 902.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a plurality of framing blades; and a multiparameter theatre light comprising a light source; and an optical component;

wherein each of the plurality of framing blades is configured to be placed in a path of the light source so that at least one surface of each of the plurality of framing blades reflects light rays from the light source;

wherein the at least one surface of each of the plurality of framing blades is comprised of a plurality of peaks and a plurality of troughs, such that the at least one surface alternates between a peak and a trough; and wherein light rays incident on the at least one surface with the same angle of incidence with respect to a plane including and parallel to a length and a width, wherein the length is perpendicular to the width, for each of the plurality of framing blades, have a different angle of reflection with respect to the plane for each of the plurality of framing blades, depending on which part of the at least one surface, the light rays are incident on;

wherein the plurality of framing blades include a first framing blade and a second framing blade;

wherein the apparatus further includes a first motor component configured to move the first framing blade from out of the path of the light source to into the path of the light source, and to thereby move the first framing blade with respect to the second framing blade; and wherein the apparatus further includes a second motor component configured to move the second framing blade from out of the path of the light source to into the path of the light source, and to thereby move the second framing blade with respect to the first framing blade.

2. The apparatus of claim 1 wherein the first framing blade and the second framing blade do not overlap.

3. The apparatus of claim 1 wherein the first framing blade and the second framing blade overlap.

4. The apparatus of claim 1 wherein the plurality of framing blades include a third framing blade and a fourth framing blade;

wherein the apparatus further includes a third motor component configured to move the third framing blade from out of the path of the light source to into the path of the light source, and to thereby move the third framing blade with respect to the fourth framing blade; and wherein the apparatus further includes a fourth motor component configured to move the fourth framing blade from out of the path of the light source to into the path of the light source, and to thereby move the fourth framing blade with respect to the third framing blade.

5. The apparatus of claim 4 wherein the first framing blade is configured to move towards the second framing blade in a first direction to move the first framing blade into the path of the light source;

the second framing blade is configured to move towards the first framing blade in a second direction, which opposes the first direction, to move the second framing blade into the path of the light source;

the third framing blade is configured to move towards the fourth framing blade in a third direction to move the third framing blade into the path of the light source;

the fourth framing blade is configured to move towards the third framing blade in a fourth direction, which opposes the third direction, to move the fourth framing blade into the path of the light source; and wherein the first and second directions are substantially perpendicular to the third and the fourth directions.

6. An apparatus comprising:

a plurality of framing blades; and a multiparameter theatre light comprising a light source; and an optical component;

wherein each of the plurality of framing blades is configured to be placed in a path of the light source so that at least one surface of each of the plurality of framing blades reflects light rays from the light source;

wherein the at least one surface of each of the plurality of framing blades is comprised of a plurality of peaks and a plurality of troughs, such that the at least one surface alternates between a peak and a trough; and wherein light rays incident on the at least one surface with the same angle of incidence with respect to a plane including and parallel to a length and a width, wherein the length is perpendicular to the width, for each of the plurality of framing blades, have a different angle of reflection with respect to the plane for each of the plurality of framing blades, depending on which part of the at least one surface, the light rays are incident on;

wherein each of the plurality of framing blades includes a coating and a base, wherein the coating is applied to a first side of the base, and a second side of the base, opposite the first side of the base, does not have the coating;

wherein the at least one surface of each of the plurality of framing blades is a surface of the coating; and wherein the surface of the coating provides less reflection of light directed onto the at least one surface for each of the plurality of framing blades, compared to light directed onto the second side of the base, for each of the plurality of framing blades; and wherein the coating is a dry film lubricant comprised of molybdenum or graphite or tungsten.

7. The apparatus of claim 6 wherein the plurality of framing blades include a first framing blade and a second framing blade;

wherein the apparatus further includes a first motor component configured to move the first framing blade from out of the path of the light source to into the path of the light source, and to thereby move the first framing blade with respect to the second framing blade; and wherein the apparatus further includes a second motor component configured to move the second framing blade from out of the path of the light source to into the path of the light source, and to thereby move the second framing blade with respect to the first framing blade.

8. The apparatus of claim 7 wherein the first framing blade and the second framing blade do not overlap.

9. A method comprising the steps of:

placing a first framing blade in the path of a light source of a multiparameter theatre light having an optical component, so that at least one surface of the first framing blade reflects light rays from the light source;

wherein the at least one surface of the first framing blade is comprised of a plurality of peaks and a plurality of troughs, such that the at least one surface of the first framing blade alternates between a peak and a trough; and wherein light rays incident on the at least one surface of the first framing blade with the same angle of incidence with respect to a plane including and parallel to a length and a width of the first framing blade, wherein the length is perpendicular to the width, have a different angle of reflection with respect to the plane for the first framing blade, depending on which part of the at least one surface of the first framing blade, the light rays are incident on;

wherein the multiparameter theatre light includes a plurality of framing blades including the first framing blade and a second framing blade;

wherein the multiparameter theatre light further includes a first motor component configured to move the first framing blade from out of the path of the light source to into the path of the light source, and to thereby move the first framing blade with respect to the second framing blade; and wherein the multiparameter theatre light further includes a second motor component configured to move the second framing blade from out of the path of the light source to into the path of the light source, and to thereby move the second framing blade with respect to the first framing blade.

10. The method of claim 9 further comprising placing one or more further framing blades of the plurality of framing blades in the path of the light source of the multiparameter theatre light having the optical component, so that at least one surface of the one or more further framing blades reflect light rays from the light source;

wherein the at least one surface of the one or more further framing blades is comprised of a plurality of peaks and a plurality of troughs, such that the at least one surface of the one or more further framing blades alternates between a peak and a trough; and wherein light rays incident on the at least one surface of the one or more further framing blades, with the same angle of incidence with respect to a plane including and parallel to a length and a width for the one or more further framing blades, wherein the length and width of each of the one or more further framing blades are perpendicular to each other, have a different angle of reflection with respect to the plane for the one or more further framing blades, depending on which part of the at least one surface of the one or more further framing blades, the light rays are incident on;

and wherein the first framing blade and the second framing blade do not overlap.

11. The method of claim 10 wherein the plurality of peaks and the plurality of troughs, for each of the plurality of framing blades, are formed by texturing.

12. The method of claim 10 wherein the plurality of peaks and the plurality of troughs, for each of the plurality of framing blades, are formed by embossing.

13. The method of claim 10 wherein the plurality of peaks and the plurality of troughs, for each of the plurality of framing blades, are geometrically arranged.

14. The method of claim 10 wherein the angle of reflection with respect to the plane for each of the plurality of framing blades is substantially different from the angle of incidence with respect to the plane for each of the plurality of framing blades, for a plurality of the light rays incident on the at least one surface.

15. The method of claim 9 wherein the first framing blade and the second framing blade overlap.

16. The method of claim 9 wherein the plurality of framing blades include a third framing blade and a fourth framing blade;

wherein the multi-parameter theatre light further includes a third motor component configured to move the third framing blade from out of the path of the light source to into the path of the light source, and to thereby move the third framing blade with respect to the fourth framing blade; and wherein the multi-parameter theatre light further includes a fourth motor component configured to move the fourth framing blade from out of the path of the light source to into the path of the light source, and to thereby move the fourth framing blade with respect to the third framing blade.

17. The method of claim 16 wherein the first framing blade is configured to move towards the second framing blade in a first direction to move the first framing blade into the path of the light source;

the second framing blade is configured to move towards the first framing blade in a second direction, which opposes the first direction, to move the second framing blade into the path of the light source;

the third framing blade is configured to move towards the fourth framing blade in a third direction to move the third framing blade into the path of the light source;

the fourth framing blade is configured to move towards the third framing blade in a fourth direction, which opposes the third direction, to move the fourth framing blade into the path of the light source; and wherein the first and second directions are substantially perpendicular to the third and the fourth directions.

18. A method comprising the steps of:

placing a first framing blade in the path of a light source of a multiparameter theatre light having an optical component, so that at least one surface of the first framing blade reflects light rays from the light source;

wherein the at least one surface of the first framing blade is comprised of a plurality of peaks and a plurality of troughs, such that the at least one surface of the first framing blade alternates between a peak and a trough; and wherein light rays incident on the at least one surface of the first framing blade with the same angle of incidence with respect to a plane including and parallel to a length and a width of the first framing blade, wherein the length is perpendicular to the width, have a different angle of reflection with respect to the plane for the first framing blade, depending on which part of the at least one surface of the first framing blade, the light rays are incident on further comprising placing one or more further framing blades in the path of the light source of the multiparameter theatre light having the optical component, so that at least one surface of the one or more further framing blades reflect light rays from the light source;

wherein the at least one surface of the one or more further framing blades is comprised of a plurality of peaks and a plurality of troughs, such that the at least one surface of the one or more further framing blades alternates between a peak and a trough; and wherein light rays incident on the at least one surface of the one or more further framing blades, with the same angle of incidence with respect to a plane including and parallel to a length and a width for the one or more further framing blades, wherein the length and width of each of the one or more further framing blades are perpendicular to each other, have a different angle of reflection with respect to the plane for the one or more further framing blades, depending on which part of the at least one surface of the one or more further framing blades, the light rays are incident on;

wherein the first framing blade and the one or more further framing blades make up a plurality of framing blades; and wherein each of the plurality of framing blades includes a coating and a base, wherein the coating is applied to a first side of the base, and a second side of the base, opposite the first side of the base, does not have the coating;

wherein the at least one surface of each of the plurality of framing blades is a surface of the coating; and wherein the surface of the coating provides less reflection of light directed onto the at least one surface for each of the plurality of framing blades, compared to light directed onto the second side of the base, for each of the plurality of framing blades; and wherein the coating is a dry film lubricant comprised of molybdenum or graphite or tungsten.

19. The method of claim 18 wherein the multiparameter theatre light includes a plurality of framing blades including the first framing blade and a second framing blade;

wherein the multiparameter theatre light further includes a first motor component configured to move the first framing blade from out of the path of the light source to into the path of the light source, and to thereby move the first framing blade with respect to the second framing blade; and wherein the multiparameter theatre light further includes a second motor component configured to move the second framing blade from out of the path of the light source to into the path of the light source, and to thereby move the second framing blade with respect to the first framing blade.

20. The method of claim 19 wherein the first framing blade and the second framing blade do not overlap.

* * * * *